US007043804B1

(12) United States Patent
Goineau et al.

(10) Patent No.: US 7,043,804 B1
(45) Date of Patent: May 16, 2006

(54) METHOD TO PRODUCE IMPROVED POLYMERIC YARN

(75) Inventors: André M. Goineau, Williamston, SC (US); Jerry N. King, Reidville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 08/863,113

(22) Filed: May 27, 1997

(51) Int. Cl.
*D02J 1/22* (2006.01)

(52) U.S. Cl. ..... 28/240; 28/245

(58) Field of Classification Search ..... 28/219, 28/240, 246, 247, 249, 258, 220, 245
See application file for complete search history.

(56) References Cited

U.S. PATENT DOCUMENTS

| | | | | | |
|---|---|---|---|---|---|
| 2,956,330 | A | * | 10/1960 | Pitzl | 28/240 |
| 3,400,194 | A | * | 9/1968 | Bonne et al. | 28/245 |
| 4,043,010 | A | * | 8/1977 | Gorrafa | 28/240 |
| 4,226,079 | A | * | 10/1980 | Mountney et al. | 28/220 |
| 4,736,500 | A | * | 4/1988 | Goineau | 28/220 |
| 5,172,459 | A | * | 12/1992 | Goineau | 28/240 |
| 5,259,098 | A | * | 11/1993 | Gupta | 28/240 |
| 5,558,825 | A | * | 9/1996 | Ueda et al. | 28/245 |
| 6,096,822 | A | | 8/2000 | Seven et al. | 524/413 |

OTHER PUBLICATIONS

"Textiles for Residential and Commercial Interiors," Texturing, by Jan Yeager, West Virginia University, copyright 1988 by Harper & Row, Publishers, Inc.

"Compilation of ASTM Standard Definitions, " Eight Edition, copyright by American Society for Testing amd Materials, Philadelphia, PA, 1994, pp. 267.

"PERP Program —New Report Alert", Aug. 2004 From www.chemsystems.com/newsletters/perp/Aug04 —NO3S8.cmf.

"Polyester Fibers", Apr. 2004—Raghavendra R. Hegde, Atul Dahiya, M.G. Kamath.

* cited by examiner

*Primary Examiner*—Danny Worrell
(74) *Attorney, Agent, or Firm*—Terry T. Moyer

(57) ABSTRACT

A process to produce a fully oriented polyester yarn from a POY polyester yarn by drawing the POY yarn at a high draw ratio in the range of 1.8–2.3.

8 Claims, 2 Drawing Sheets

METHOD TO PRODUCE IMPROVED POLYMERIC YARN

This invention relates generally to the production of a fully oriented industrial type yarn from a commercially available low molecular weight synthetic, multifilament POY polymeric apparel yarn such as polyester.

Commercially it is very expensive to purchase fully oriented industrial polymeric yarn from the fiber producer but partially oriented polymeric (POY) apparel yarns are readily available at reasonable prices but have to be drawn to produce a fully oriented yarn that is usable in many of today's industrial fabrics.

It is therefore an object of the invention to provide a method to treat POY apparel yarn to produce a fully oriented yarn which is acceptable for use in the production for commercially usable industrial woven and/or knit fabrics.

Figure 1:
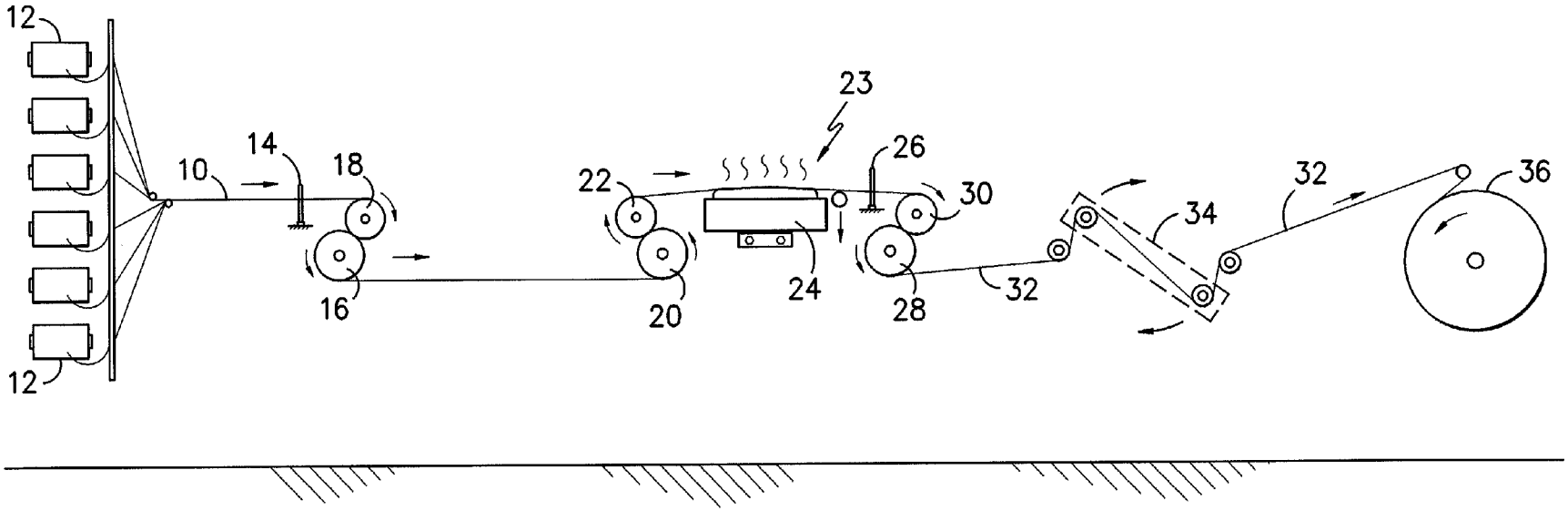
Figure 2:
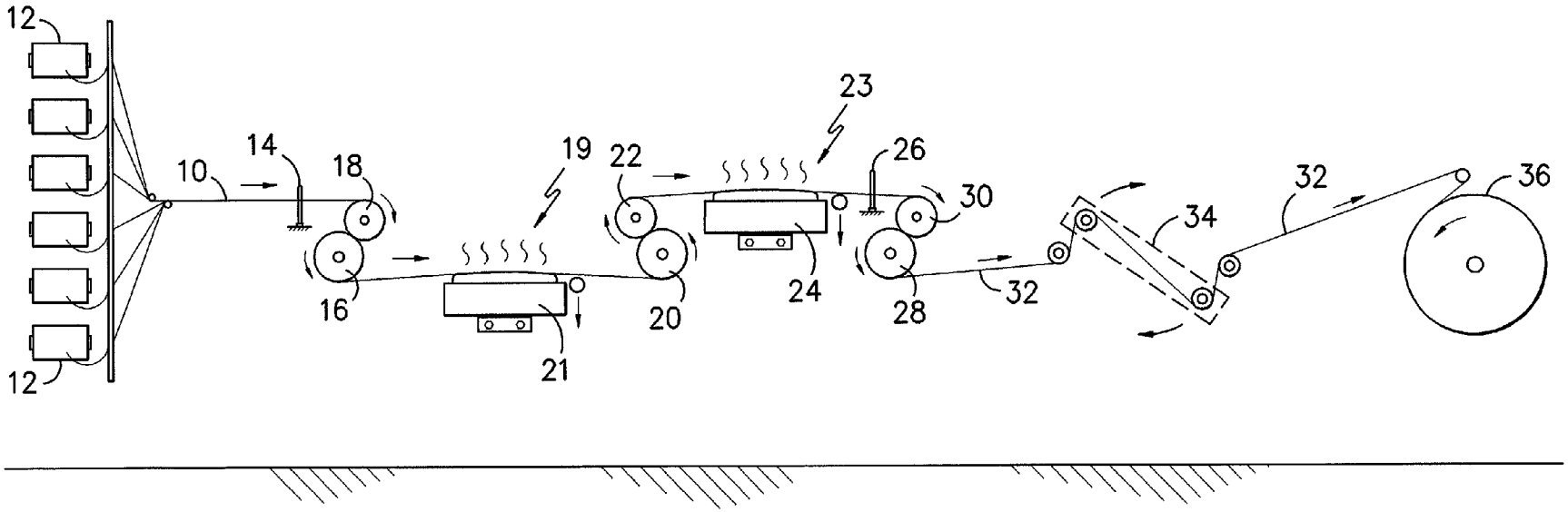

Other objects and advantages of the invention will become clearly apparent as the specification proceeds to describe the invention with reference to the accompanying drawings, in which:

FIG. 1 is a schematic representative of the yarn treating process to be described herein and FIG. 2 is a modification of the process shown in FIG. 1.

As discussed briefly, the invention is directed to low molecular weight POY multifilament, synthetic polymeric yarn such as polyester, nylon, etc. but in the preferred embodiment of the invention, a low molecular weight polyester 255 denier, 34 filament yarn 10 is shown being supplied from bobbins 12 through a reed 14 to the rolls 16, 18. The speed of the rolls 16, 18 and rolls 20, 22 is selected to pretension the yarn 10 with a draw ratio of 1.01. The yarn 10 is then supplied to the draw zone 23 over the contact heater 24 operating at a temperature of 210° C. The speed of the rolls 20, 22 and the rolls 28, 30 is selected to draw the yarn 10 therebetween with a draw ratio of 2.093 to produce the fully drawn or oriented yarn 32. Prior to the nip of the rolls 28, 30, the yarns 10 are maintained in a spaced apart position by the reed 26. As clearly shown in FIGS. 1 and 2, the fully drawn yarn 32 then passes through the dancer roll arrangement 34 at a speed of 200 yards per minute to the take-up roll 36 without further processing.

The process of FIG. 2 is similar to that of FIG. 1 except that the yarn 10 is drawn in two hot draw stages with the heaters 19 and 24, both operating at a temperature of 210° C. In this modification, the drawing of the yarn 10 is done in Zone 1, designated 21, at a draw ratio of 2.114 with the draw Zone 2, designated 23, being used at the relaxing zone with a draw ratio of 0.940 to produce the desired fully oriented polyester yarn 32.

Today polyester products are typically spun in the partially oriented form (POY) which requires further drawing in the next processing step such as texturing, winding or twisting. The level of orientation achieved in the spinning operation determines the amount of drawing required to "fully orient" the yarn for final end uses.

An equation describing hot draw behavior is as follows:

$$\text{DRAWRATIO} = A \times LN\left(B \times \frac{\text{FINAL}}{\text{SPUN}}\right) + C$$

where:

| | |
|---|---|
| DRAWRATIO = | Draw Ratio required to Achieve Desired Final Orientation |
| FINAL = | Final Orientation Measurement |

-continued

| | |
|---|---|
| SPUN = | As Spun Orientation Measurement |
| A, B, & C = | Material Property Constants Determined During Experimentation |
| LN = | Denotes Natural Logarithm |

NOTE:
The orientation measurement can be the quantitative results of any of the accepted methods for determining molecular orientation of polyester.

Experiments conducted using draw stress as a measure of molecular orientation resulted in the following equation:

$$DRAWRATIO = 0.2611 \times LN\left(0.7649 \times \frac{FINALSTRESS}{ORIENTATIONINDEX}\right) + 1.67$$

where:

| | |
|---|---|
| FINALSTRESS = | Stress (cn/denier) at final orientation |
| ORIENTATIONINDEX = | Stress (cn/denier) at a draw ratio of 1.6 |
| CN = | CentiNewton |

If a drawing operation is designed to produce a product with fixed properties such as final orientation, tenacity and elongation using polyesters spun at different conditions, the process draw ratio can be adjusted to accommodate the different POY properties. The following table provides an example:

| POY ORIENTATION INDEX | PROCESS DRAW RATIO |
|---|---|
| 0.2 CN/DENIER | 2.201 |
| 0.3 CN/DENIER | 2.095 |
| 0.4 CN/DENIER | 2.020 |
| 0.5 CN/DENIER | 1.962 |
| 0.6 CN/DENIER | 1.914 |
| 0.7 CN/DENIER | 1.874 |
| 0.8 CN/DENIER | 1.839 |

The span of orientation shown in the above table represents the current range of commercially available polyester POY products. The draw ratios shown should produce a final product at the same physical properties regardless of initial POY orientation. By selecting a draw ratio in the range of 1.8–2.3 provides a fully oriented polyester yarn at the same physical properties regardless of the initial POY orientation.

It can be seen that we have described a process in which commercially available POY apparel polyester yarn can be processed to produce a fully oriented industrial yarn which is acceptable for use in commercial fabrics without the expense of purchasing fully oriented yarn from the fiber producer. As is well known, industrial yarns with extreme high draw stress level are produced out of high molecular weight polyester which require an expensive poly condensation process resulting in a high price. The disclosed process produces an industrial yarn with the desired draw stress level from a commercially available relatively inexpensive lower molecular weight apparel POY polyester yarn.

Although we have described the preferred embodiment of our invention, we contemplate that many changes may be made without departing from the scope or spirit of our invention and we desire to be limited only by the claims.

What is claimed is:

1. A process to provide a fully oriented industrial yarn from a low molecular weight polyester partially oriented yarn comprising the steps of: providing a bobbin of low molecular weight polyester POY multifilament yarn, supplying the yarn to a heater, drawing said yarn in a draw zone in the range of 1.8–2.3 as it passes over the heater to produce a fully oriented, industrial yarn and supplying the fully oriented, industrial yarn directly to a take-up roll, wherein said yarn travels along a path between the draw zone and the take-up roll with processing along said path limited to controlled conveyance tensioning.

2. The process of claim 1 wherein said yarn is pretensioned prior to the supply of same to the draw zone.

3. The process of claim 2 wherein said heater is operating at about a temperature of about 210° C.

4. The method of claim 3 wherein the yarn is pretensioned with a draw ratio of 1.01.

5. The process of claim 1 wherein said drawn yarn is supplied to a second draw zone wherein it is relaxed.

6. The process of claim 5 wherein heat from a heater operating at about 210° C. relaxes said drawn yarn.

7. The process of fully orienting a 255 denier, 34 filament low molecular weight polyester yarn comprising the steps of: supplying a 255 denier, 34 filament low molecular weight POY yarn, heating and drawing said yarn with a draw ratio of 2.093 to produce a fully oriented industrial yarn and taking up the fully oriented yarn.

8. The process of claim 7 wherein the heater for said yarn is operated at a temperature of about 210° C.

* * * * *